United States Patent [19]

Sadahiro

[11] Patent Number: 4,632,599

[45] Date of Patent: Dec. 30, 1986

[54] ROLLER DRUM OF A SOIL COMPACTING MACHINE

[75] Inventor: Hisanori Sadahiro, Kawagoe, Japan

[73] Assignee: Sakaijuhkogyo Kabushiki Kaisha, Tokyo, Japan

[21] Appl. No.: 633,949

[22] Filed: Jul. 24, 1984

[30] Foreign Application Priority Data

Jul. 26, 1983 [JP] Japan ..... 58-116112[U]
Aug. 19, 1983 [JP] Japan ..... 58-127958[U]

[51] Int. Cl.[4] ..... E01C 19/23

[52] U.S. Cl. ..... 404/124; 404/121; 404/128

[58] Field of Search ..... 404/103, 121, 122, 124, 404/128, 132; 172/535, 539, 541; 180/20; 301/39 CC

[56] References Cited

U.S. PATENT DOCUMENTS 348,284 8/1886 Horton ..... 404/128 X
1,752,682 4/1930 McConnell ..... 404/128 X
1,935,950 11/1933 Lawrence ..... 404/128 X
3,486,427 12/1969 Waschulewski et al. ..... 404/103
3,610,116 10/1971 Viefhaus ..... 404/121
3,989,404 11/1976 Burton ..... 404/124 X
4,201,493 5/1980 Braun ..... 404/122 X

FOREIGN PATENT DOCUMENTS 132258 2/1960 U.S.S.R. ..... 404/103

*Primary Examiner*—James A. Leppink
*Assistant Examiner*—Matthew Smith
*Attorney, Agent, or Firm*—Basile, Weintraub & Hanlon

[57] ABSTRACT

In a compacting machine for compacting a road or the like, the machine has a pre-assembled primary roller drum 4 and another roller drum 20 which perform a different compaction function than that of the primary roller drum. The roller drum 20 is formed by providing a plurality of split roller segments 21, 22. The segments are formed by dividing an annular wall member, at circumferentially different portions in the axial direction into a plurality of split roller segments having a mounting portion. Then the segments are combined together and detachably mounted to the outer surface of the roller drum 4 of the compacting machine.

2 Claims, 6 Drawing Figures

ROLLER DRUM OF A SOIL COMPACTING MACHINE

BACKGROUND OF THE INVENTION

1. Field of the Invention

This invention relates to a roller drum and split drum segments of a soil compacting machine. More particularly, the present invention relates to a roller drum, around the outer circumference of which, another roller drum for carrying out another compacting job can be detachably mounted thereto. Even more particularly, the present invention concerns a roller drum of the type described for carrying out a plurality of different compacting operations by using only one kind of compacting machine.

2. Prior Art

Generally, compacting apparatus or machines, which reduce the extent of porosity between particles in a soil by rotating rollers, are used to increase the supporting force of the soil or a material layer constituting a road or the like. Naturally, some different compacting effects would be performed if a surface configuration of a roller drum can be, optionally, altered.

In the conventional compacting machine of the type under consideration herein, different types of roller drums are employed for different compacting effects. For instance, there is a flat-type roller having a flat and smooth outer circumference as well as a tamping roller having on its outer circumference a large number of fixed tamper feet, depending upon the intended purposes of the tamping operation, as well as the nature of soil or soils to be compacted for densification.

However, conventional compacting machines of such kind have required, in each instance, replacing the roller drum attached to the machine with another one. Each roller drum is prepared as a roller drum assembly. This requires detaching the pipings for the oil hydraulic motor for travelling and another oil hydraulic motor for causing vibration and, then, re-assembling them. This requires a considerable amount of replacement work and the accompanying large amount of man-hours but, also, troubles are liable to occur in the connection of piping joints, which may degrade the reliability of the oil pressure means.

In addition, this kind of replacement requires taking care of the roller drum assembly which has been disassembled and removed from the machine so that it does not become rusted or gather dust. This is troublesome maintenance for the unused assembly and requires somewhat high grade of working environment for the drum replacing operation. This invention has been made in view of the drawbacks mentioned above.

OBJECTS OF THE INVENTION

Accordingly, an object of the invention is to provide a compacting machine which can readily change the operational characteristics of the compaction by changing the surface configuration of the roller drum by a simple and readily operable changing process.

Another object of the present invention is to provide a compacting machine which has less chance of degrading the reliability of the hydraulic pressure equipment and does not require any strict procedure for preventing rust or dust and, thus, can be readily maintained.

A still further object of the invention is to provide split roller bodies to be used with a compacting machine of the type under consideration.

SUMMARY OF THE INVENTION

This invention provides a compacting machine for compacting and densifying a material layer by travelling roller drums over the material layer which comprises: (a) a primary roller drum for performing a compacting function, and (b) a plurality of split roller segments for performing another compacting function. The segments, which are annular segments, are detachably mounted around the outer peripheral surface of the primary roller drum which is coupled to the driving shaft of the machine. Each of the segments has respective mounting means adapted to be coupled to the primary roller drum.

For a more complete understanding of the present invention, reference is made to the following detailed description and accompanying drawing. In the drawing like reference characters refer to like parts throughout the several views in which:

DETAILED DESCRIPTION OF THE PREFERRED EMBODIMENTS

Figure 1:
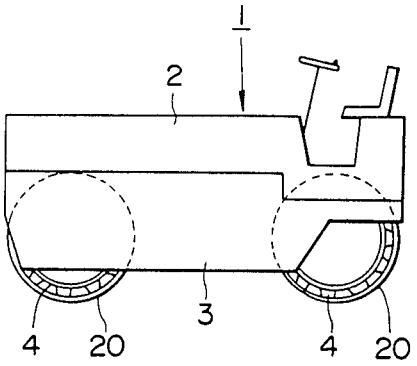
FIG. 1 is an elevational view of a compacting machine in accordance with the present invention.
Figure 3:
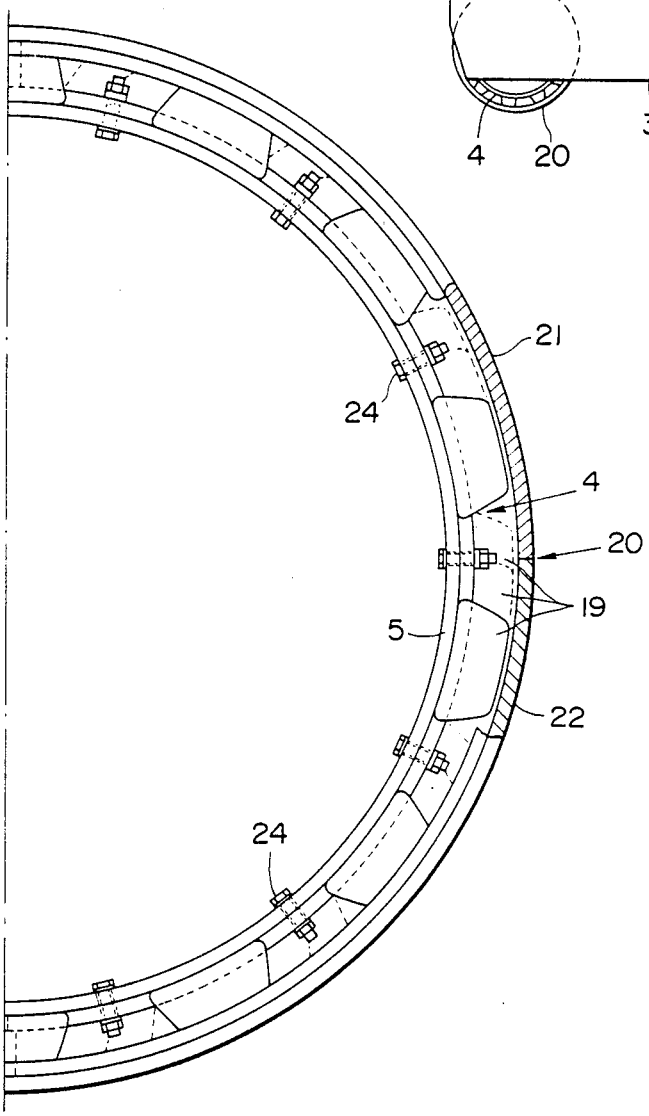
FIG. 3 is a side view, partly in section, of the roller drum of FIG. 2.

Now, and with reference to the drawing there is shown in FIG. 1 a vibratory roller or compacting machine 1.

Figure 2:
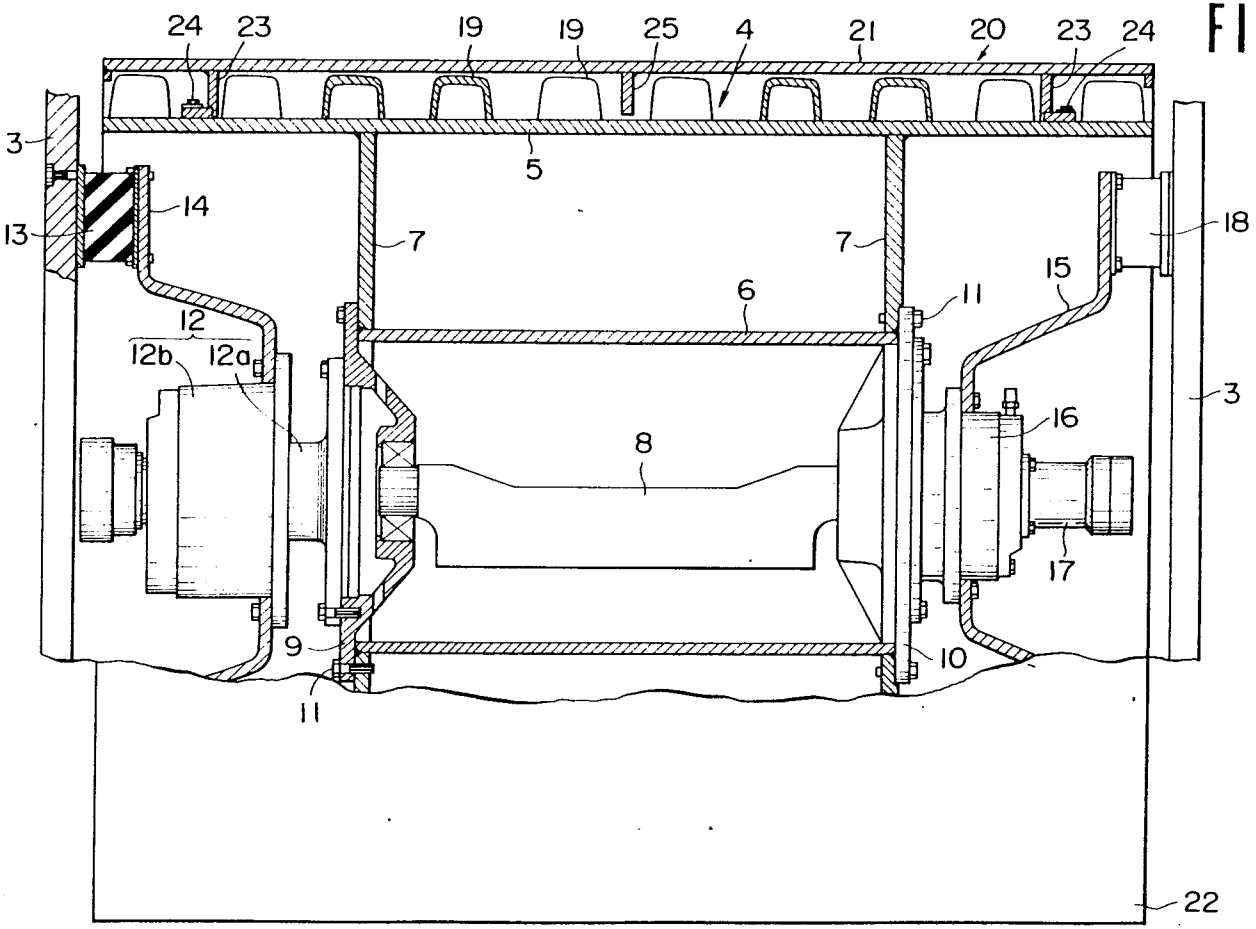
FIG. 2 is a partial cross-sectional view of the roller drum of the invention.

The machine 1 includes two tamping rollers 4. A first roller is mounted at the front part and the other at the rear part of the vehicle. The rollers 4 are positioned to be interposed between the left side frame plate and the right side frame plate 3—3 at the lower part of the body 2 of the vehicle 1. Each tamping roller 4, as shown in FIG. 2, comprises an outer cylinder 5 and an open-ended inner cylinder 6 which is coaxial with the outer cylinder. The cylinders 5 and 6 are fixed together by welding or the like through a pair of doughnut-like annular frames 7.

The open-ended cylinder 6 has each end filled by a holder 9, 10, respectively. Each holder 9, 10 rotatably receives each axial end of a vibratory shaft 8, and are tightly fixed to the frame 7 by a plurality of bolts 11. The holder 9, shown as being disposed at the left side in the drawing, is connected to the axial end of a rotary member 12*a* of an oil hydraulic motor 12.

The axially innermost part of a stationary part 12*b* of the oil hydraulic motor 12 is coupled to and relatively rotatable with the rotary member and is fixed to an axle plate 14. The axle plate 14 is resiliently supported by the frame plate 3 via an annular shock-absorbing rubber 13.

The other holder 10, shown as being positioned at the right side of the drawing, is received by a housing 16 fixed to an axle plate 15 via a bearing (not shown).

Fixedly attached to the housing 16 is an oil hydraulic motor 17 for actuating vibratory motion. The rotary shaft of the hydraulic motor 17 is coupled to one axial end of the vibratory shaft 8 via an intermediate shaft (not shown).

The axle plate 15, to which the housing 16 is fixed, is resiliently supported to the frame plate 3 via an annular shock-absorbing rubber member 18.

In operation, when the oil hydraulic motor 12, for travelling the compaction vehicle, is actuated the rotary member 12*a*, the left side holder 9, and the tamping roller 4 are rotated together and the vehicle will start travelling. Actuation of the oil hydraulic vibration motor 17 will rotate the vibratory shaft 8 and will impart vibration to the tamping roller 4.

Figure 4:
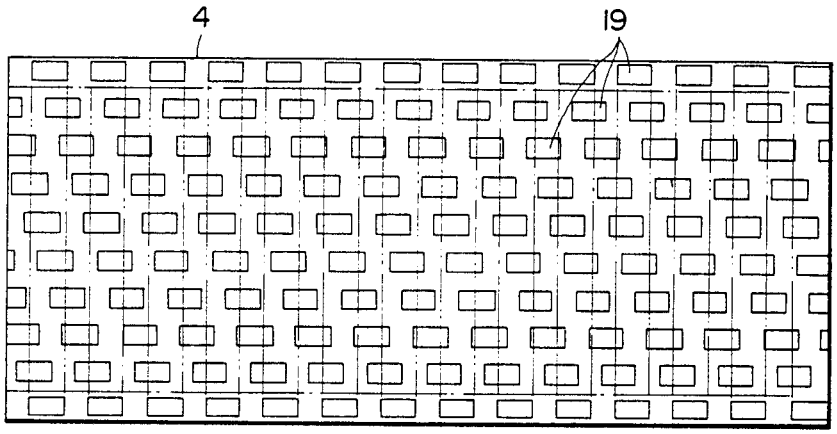
FIG. 4 is a developed view of the outer surface of the roller drum.

The tamping roller 4 has, as shown in FIG. 4, a large number of tamper feet 19 disposed, by welding, on the outer surface of a steel roller drum. The tamper feet 19 are arranged in a plurality of arrays disposed transverse to the width of the steel roller drum. In each array the tamper feet 19 are aligned along the side face of the roller drum. The arrays are arranged to be slightly shifted, one after another, along the width of the roller drum.

A circular roller plate 20 is attached around the outer surface of the tamping roller 4 to define a flat-type roller 20. This flat-type roller 20 comprises two split roller segments 21, 22 formed by dividing, in the axial direction, a circular cylindrical wall into two halves, at circumferentially different portions. The two roller segments 21, 22 are placed together at their split diametrical faces to define a cylindrical roller drum.

Figure 6:
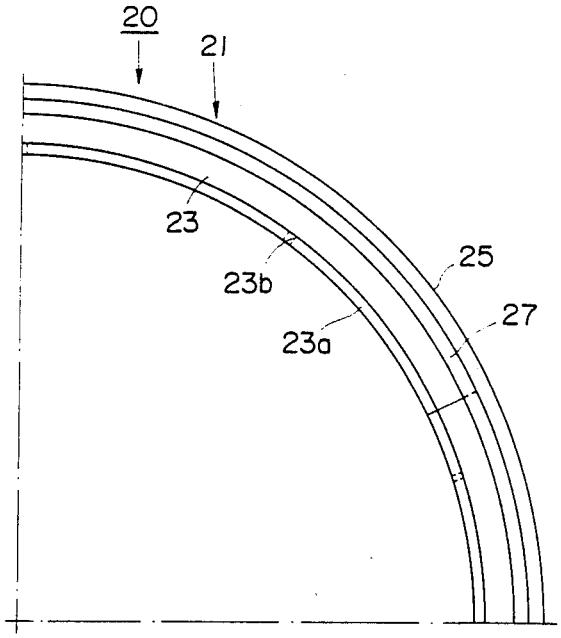
FIG. 6 is a right side view of the split roller drum shown in FIG. 5.
Figure 5:
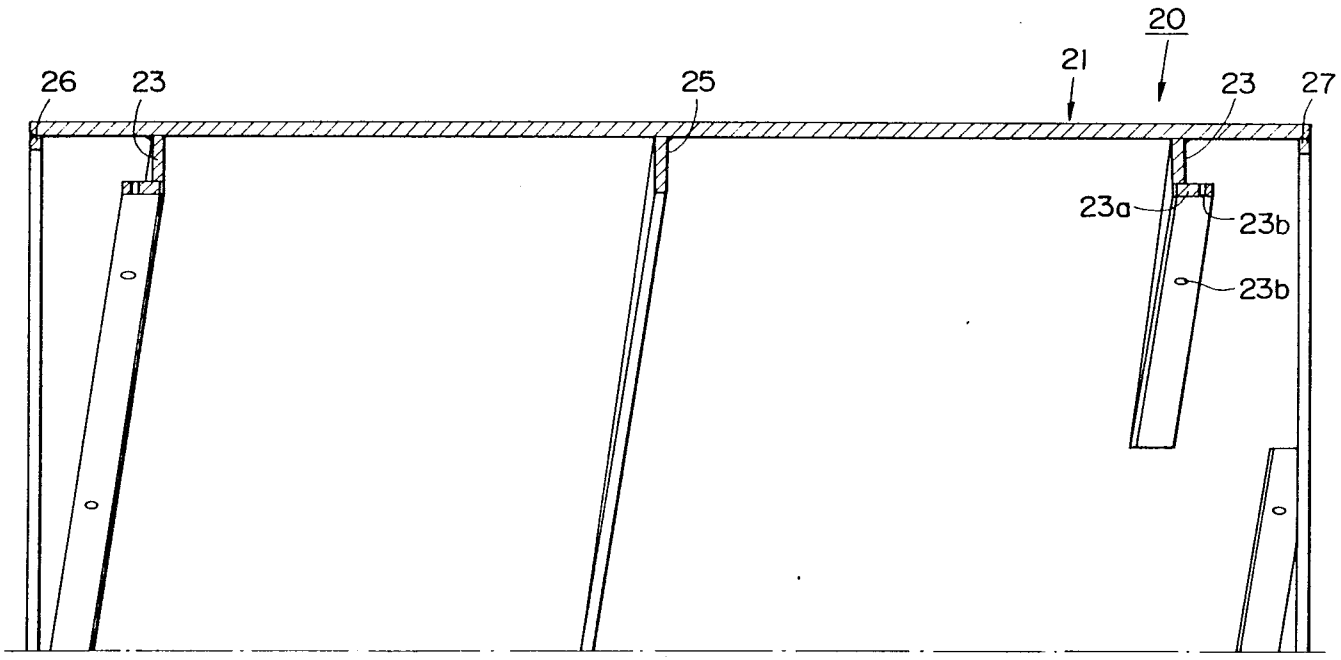
FIG. 5 is a sectional view of a split roller segment showing mounting frames and a reinforcing frame.

As shown in FIGS. 2, 5 and 6, the inner face of each of the split roller segments 21, 22 has obliquely extending arcuate mounting portions 23 and a reinforcing frame 25. Both the frame 25 and the portions 23 are fixed, by welding, along the space defined between the arrayed tamper feet such that the frame portions 23 and the frame 25 extend, in a spiral direction, spirally along the inner face of the roller drum, when the two split roller segments 21 and 22 are assembled together.

The base portion of the mounting portions 23 are fixedly attached to the outer face of the tamping roller 4 by passing bolts 24 through respective mounting holes 23*b*, formed on a mounting shoe 23*a*, and then by tightening. In this manner, the split roller segments 21, 22 can be attached to the outer surface of the tamping roller 4.

As shown in FIGS. 5 and 6, outer frame ribs 26, 27, for structural support, are disposed at the outer axial extremity of each of the split roller segments 21 and 22.

Next, explanation will now be made on the operation of this invention.

The vibratory roller 1, without being equipped with the split roller segments 21, 22, functions as a vibratory roller with the tamping roller 4 and is able to perform compaction, kneading for drying, mixing of the soil, and displays the peculiar merits of the tamping roller 4.

On the other hand, when the vibratory roller 1 is equipped with the split roller segments 21, 22 around the outer surface of the tamping roller 4, the vibratory roller 1 now functions as an ordinary vibratory roller with a flat-type roller drum and can accomplish the compacting effect mainly through the action of its vibration force.

In addition, the vibratory roller 1 can perform several kinds of compaction effects with a single vibratory roller 1, and yet with wider range of operational conditions.

In addition, alteration between the tamping roller and the flat roller can be made by a mere removal or a re-attaching of the split roller segments 21, 22. There is no need for removing oil piping or the like as encountered in the conventional vibratory roller. Thus, there is no possible fear of lowering reliability of the oil hydraulic means due to poor connection between the piping joints, oil leakage or the like.

Moreover, replacement of the vibratory roller 1 can be made by the split roller segments 21, 22, which are considerably lighter in weight, as compared with the roller assembly. Accordingly, replacement can be remarkably simplified, without necessitating any particular consideration for environment in the replacement operation. Since there is no need for taking care of the split roller segments, which have been removed from the roller drum to prevent formation of rust and/or the gathering of dust from occurring, maintenance of these removed roller segments can be simplified and, thus, contribute to cost reduction.

Though in the above-mentioned embodiment, the flat-type roller has been defined by a pair of split roller segments 21, 22, it goes without saying that the flat-type roller can comprise three or more rollers. Alternately, a tamping roller, also, can comprise a plurality of segments and be affixed to the outer surface of a flat-type roller drum.

Although the explanation has been made by referring to a vibratory roller, the present invention can be applied, of course, to other ordinary types of road rollers.

As explained above, since the apparatus of this invention has been constructed such that a roller drum, comprising a plurality of split roller segments are detachably attached to the outer surface of a roller drum having operational characteristics other than the outer roller, one soil compacting roller can perform a plurality of compacting operations of different characteristics and, thereby, can satisfy a wider range of compaction requirements.

In addition, the apparatus is constructed in a simple way that it requires only attaching the roller segments around the outer surface of a roller drum of another cylindrical roller member. Hence, the replacement of the attachable roller member can be done very readily and simply, without requiring any particular consideration of the working environment or the like.

Moreover, since it is not necessary to remove any pipe line for pressurized oil, there is no trouble due to any poor connection between the pipings or oil leakage. Thus, there is reliability in the oil hydraulic system and, therefore, the present invention can provide a soil compacting machine displaying a plurality of compaction characteristics with ready maintenance and reduced cost.

Having thus described the invention, what is claimed is:

1. A roller drum construction for a soil compacting machine for compacting soil such as a road by rolling the roller drum over the soil, the roller drum comprising: (a) a primary cylindrical roller drum for performing a first compacting function, and (b) an auxiliary cylindrical roller drum for performing another compacting function, detachably mounted around the cylindrical outer surface of said primary roller drum, the auxiliary drum having an inner face with a plurality of discontinuous spiral members located thereon, the discontinuous spiral members extending perpendicularly from the inner face and oriented in a spiral manner along the inner face of the auxiliary drum such that the auxiliary drum is detachably mounted to the primary drum by a connection between the discontinuous spiral members and the outer surface of the primary drum, the auxiliary roller drum comprising a plurality of split roller segments formed by dividing a cylindrical wall in the axial direction.

2. A roller drum comprising a unitary primary roller drum; a plurality of split roller segments having an inner surface, the split roller segments capable of being mounted around the primary roller drum to form an auxiliary outer drum, each split roller segment having a configuration formed by dividing a circular cylinder wall in the axial direction and having at least one discontinuously spiral mounting portion on end extending radially outwardly from the inner surface and in a spiral manner along the inner surface of the auxiliary roller drum segment, the discontinuous spiral mounting portion capable of being attached to the primary roller drum.

* * * * *

UNITED STATES PATENT OFFICE

CERTIFICATE OF CORRECTION

Patent No. 4,632,599 Dated December 30, 1986

Inventor(s) Hisanori Sadahiro

It is certified that error appears in the above-identified patent and that said Letters Patent are hereby corrected as shown below:

In Claim 2, at column 6, line 6, after "radially", please delete "outwardly" and insert --inwardly--.

In Claim 2, at column 6, line 5, after "portion on", please delete "end" and insert --and--.

Signed and Sealed this

First Day of September, 1987

*Attest:*

*Attesting Officer*

DONALD J. QUIGG

*Commissioner of Patents and Trademarks*